US005984018A

United States Patent [19]

Yamamoto et al.

[11] Patent Number: 5,984,018

[45] Date of Patent: Nov. 16, 1999

[54] DOZING SYSTEM FOR CONTROLLING A CUTTING ANGLE OF A BULLDOZER BLADE DURING DOZING OPERATION

[75] Inventors: Shigeru Yamamoto; Hidekazu Nagase, both of Osaka, Japan

[73] Assignee: Komatsu Ltd., Tokyo, Japan

[21] Appl. No.: 08/960,452

[22] Filed: Oct. 29, 1997

[30] Foreign Application Priority Data

Nov. 18, 1996 [JP] Japan ..... 8-306231

[51] Int. Cl.[6] ..... A01B 41/06

[52] U.S. Cl. ..... 172/2; 701/50; 172/818

[58] Field of Search ..... 172/2, 3, 4, 4.5, 172/7, 811, 818; 414/699; 37/438, 382; 701/50

[56] References Cited

U.S. PATENT DOCUMENTS

| | | | |
|---|---|---|---|
| 4,282,933 | 8/1981 | Suganami et al. | 172/4.5 |
| 5,462,125 | 10/1995 | Stratton et al. | 172/2 X |
| 5,487,428 | 1/1996 | Yamamoto et al. | 172/4.5 |
| 5,535,830 | 7/1996 | Matsuhita et al. | 172/7 |
| 5,555,942 | 9/1996 | Matsushita et al. | 172/3 |
| 5,564,507 | 10/1996 | Matsushita et al. | 172/3 |
| 5,620,053 | 4/1997 | Kamikawa et al. | 172/2 X |
| 5,621,643 | 4/1997 | Nakagami et al. | 364/424.07 |
| 5,694,317 | 12/1997 | Nakagami et al. | 172/2 X |
| 5,699,248 | 12/1997 | Nakagami et al. | 364/424.07 |
| 5,799,737 | 9/1998 | Kamikawa et al. | 172/2 |
| 5,819,190 | 10/1998 | Nakagami et al. | 701/50 |
| 5,860,480 | 1/1999 | Jayaraman et al. | 172/2 |
| 5,862,868 | 1/1999 | Yamamoto et al. | 172/2 |

FOREIGN PATENT DOCUMENTS

| | | |
|---|---|---|
| 58-47834 | 3/1983 | Japan . |
| 62-291337 | 12/1987 | Japan . |
| 1-163324 | 6/1989 | Japan . |
| 3-43523 | 2/1991 | Japan . |
| 4-285214 | 10/1992 | Japan . |
| 5-105239 | 4/1993 | Japan . |
| 7-11665 | 1/1995 | Japan . |
| 7-11666 | 1/1995 | Japan . |
| 7-26586 | 1/1995 | Japan . |
| 7-48855 | 2/1995 | Japan . |
| 7-48856 | 2/1995 | Japan . |
| 7-48857 | 2/1995 | Japan . |
| 7-54374 | 2/1995 | Japan . |
| 7-62683 | 3/1995 | Japan . |
| 7-252859 | 10/1995 | Japan . |
| 8-199620 | 8/1996 | Japan . |
| 8-260506 | 10/1996 | Japan . |

*Primary Examiner*—Victor Batson
*Attorney, Agent, or Firm*—Armstrong, Westerman, Hattori, McLeland & Naughton

[57] ABSTRACT

A dozing system that enables automatic control for all kinds of soil properties and less frequently requires manual control intervention. The system is designed such that the blade is lifted or lowered at a start of excavation in dozing operation in an automatic drive mode such that the actual cutting angle θ of a blade detected by an actual cutting angle detector becomes coincident with a target cutting angle (maximum cutting angle) $\theta_0$ preset by a target cutting angle setting device.

3 Claims, 13 Drawing Sheets

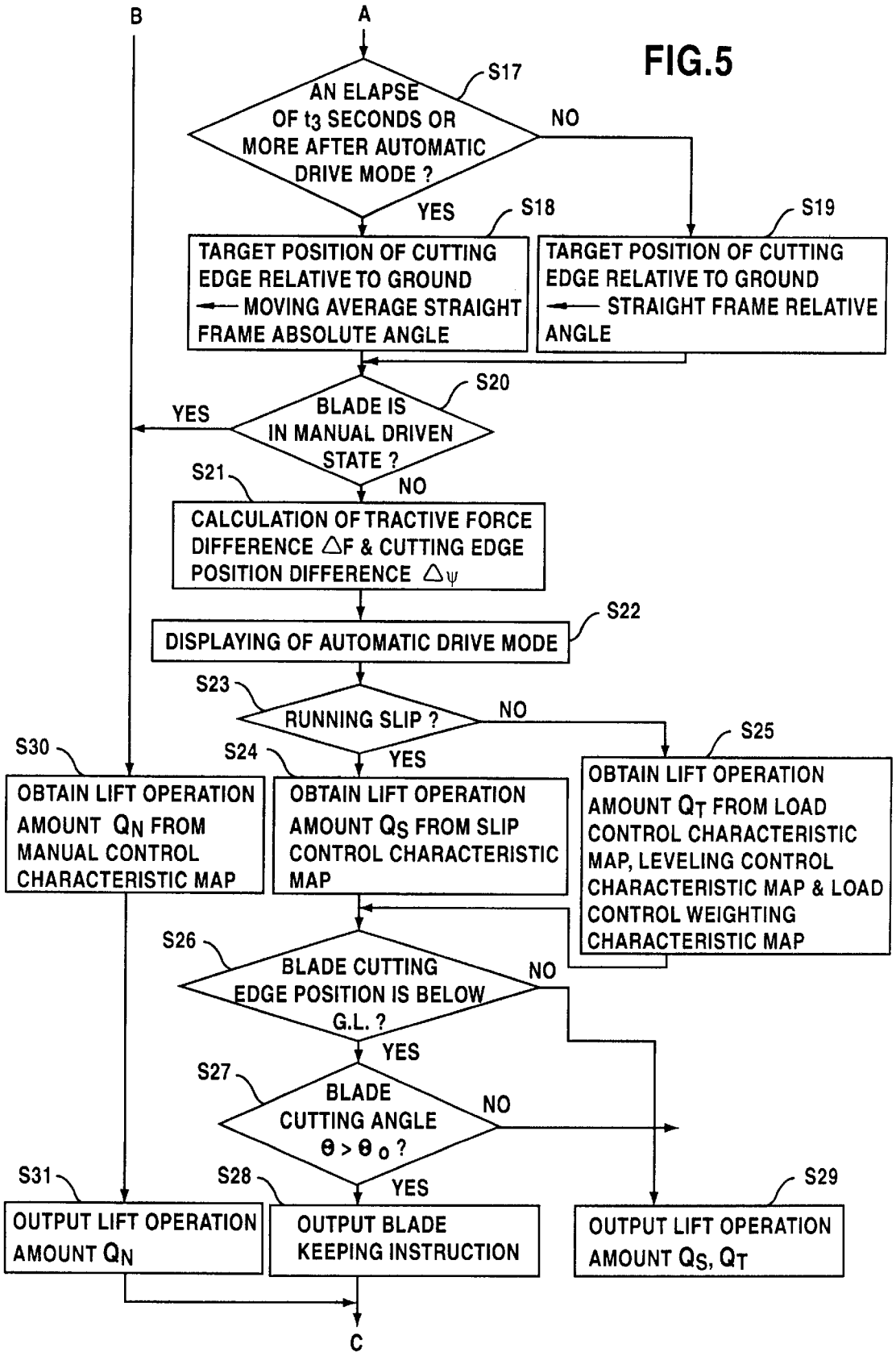
FIG.5
A
B
C
S17
AN ELAPSE OF t3 SECONDS OR MORE AFTER AUTOMATIC DRIVE MODE ?
NO
YES
S18
TARGET POSITION OF CUTTING EDGE RELATIVE TO GROUND ← MOVING AVERAGE STRAIGHT FRAME ABSOLUTE ANGLE
S19
TARGET POSITION OF CUTTING EDGE RELATIVE TO GROUND ← STRAIGHT FRAME RELATIVE ANGLE
S20
BLADE IS IN MANUAL DRIVEN STATE ?
YES
NO
S21
CALCULATION OF TRACTIVE FORCE DIFFERENCE △F & CUTTING EDGE POSITION DIFFERENCE △ψ
S22
DISPLAYING OF AUTOMATIC DRIVE MODE
S23
RUNNING SLIP ?
NO
YES
S24
OBTAIN LIFT OPERATION AMOUNT QS FROM SLIP CONTROL CHARACTERISTIC MAP
S25
OBTAIN LIFT OPERATION AMOUNT QT FROM LOAD CONTROL CHARACTERISTIC MAP, LEVELING CONTROL CHARACTERISTIC MAP & LOAD CONTROL WEIGHTING CHARACTERISTIC MAP
S30
OBTAIN LIFT OPERATION AMOUNT QN FROM MANUAL CONTROL CHARACTERISTIC MAP
S26
BLADE CUTTING EDGE POSITION IS BELOW G.L. ?
NO
YES
S27
BLADE CUTTING ANGLE θ > θ0 ?
NO
YES
S31
OUTPUT LIFT OPERATION AMOUNT QN
S28
OUTPUT BLADE KEEPING INSTRUCTION
S29
OUTPUT LIFT OPERATION AMOUNT QS, QT

DOZING SYSTEM FOR CONTROLLING A CUTTING ANGLE OF A BULLDOZER BLADE DURING DOZING OPERATION

TECHNICAL FIELD

The present invention relates to a dozing system for use in a bulldozer and more particularly to a technique for controlling the cutting angle of the blade of a bulldozer during dozing operation.

BACKGROUND ART

There has been practically used a load control system for bulldozers that performs load control to make the actual tractive force of the vehicle body coincide with a preset target tractive force, in other words, to make the load on the blade constant in order to reduce the burden imposed on the operator who manipulates the blade of the bulldozer during dozing operation.

The above load control system, however, reveals the inability to stably control the load because the blade often takes an abrupt action for example when excavation starts or when one drive mode is switched to another. The inventors have made an attempt to solve this problem and proposed a load control system for bulldozers in Japanese Patent Publication No. 7-54374(1995) according to which if there is a difference between the actual tractive force and a target tractive force at a start of excavation in an automatic drive mode, the target tractive force is gradually increased or decreased thereby to eliminate the abrupt action of the blade.

The load control system disclosed in the above publication has the problem that when a blade control is carried out during excavation of soft soil, the blade suddenly cuts into the ground so that the load control and therefore the smooth excavation are hampered. Also, the system cannot control the blade to properly cut into the ground at a start of excavation of hard soil. In such situations, there arises a need for the intervention of manual control by the operator (manual control intervention), which has been an obstacle to the introduction of automatic control.

The invention is directed to overcoming the above problems and one of the objects of the invention is therefore to provide a dozing system for use in a bulldozer, which enables the application of automatic control to excavation of all types of soil properties and reduces the frequency of manual control intervention.

DISCLOSURE OF THE INVENTION

The foregoing object can be accomplished by a dozing system for use in a bulldozer according to the invention, the system comprising:

(a) target cutting angle setting means for setting a target cutting angle of a blade when the bulldozer is in an automatic drive mode in dozing operation;

(b) actual cutting angle detecting means for detecting the actual cutting angle of the blade relative to the ground; and (c) blade control means for controlling the blade to be lifted or lowered, at a start of excavation when the bulldozer is in the automatic drive mode in dozing operation, such that the actual cutting angle of the blade detected by the actual cutting angle detecting means becomes coincident with the target cutting angle of the blade set by the target cutting angle setting means.

According to the invention, a target cutting angle of the blade relative to the ground for the automatic drive mode of dozing operation is set beforehand by the target cutting angle setting means and if there is a difference between the actual cutting angle of the blade detected by the actual cutting angle detecting means and the target cutting angle preset by the target cutting angle setting means when starting excavation in the automatic drive mode in dozing operation, the blade is lifted or lowered such that the actual cutting angle becomes coincident with the target cutting angle. In this way, the blade is controlled to conform to the preset target cutting angle, which allows the blade to smoothly, properly cut into the ground at a start of excavation, irrespective of soil conditions, that is, whether the soil to be excavated is soft or hard. This arrangement makes it possible to provide a dozing system which less frequently requires the manual control intervention by the operator and therefore performs easier automatic control.

In the invention, the actual cutting angle detecting means may determine the actual cutting angle from the digging depth from a reference level which digging depth corresponds to the travel distance of the bulldozer from an excavation starting point, or from a change in the position of the cutting edge of the blade per unit travel distance.

The target cutting angle setting means may set a target cutting angle using a dial switch or using a look-up data map that shows the relationship between the travel distance of the bulldozer and the position of the cutting edge of the blade.

BRIEF DESCRIPTION OF DRAWINGS

FIG. 5 is a flow chart (second stage) of the operation performed by the dozing system.

BEST MODE FOR CARRYING OUT THE INVENTION

Referring now to the accompanying drawings, a preferred embodiment of the dozing system for use in a bulldozer of the invention will be described.

Figure 1:
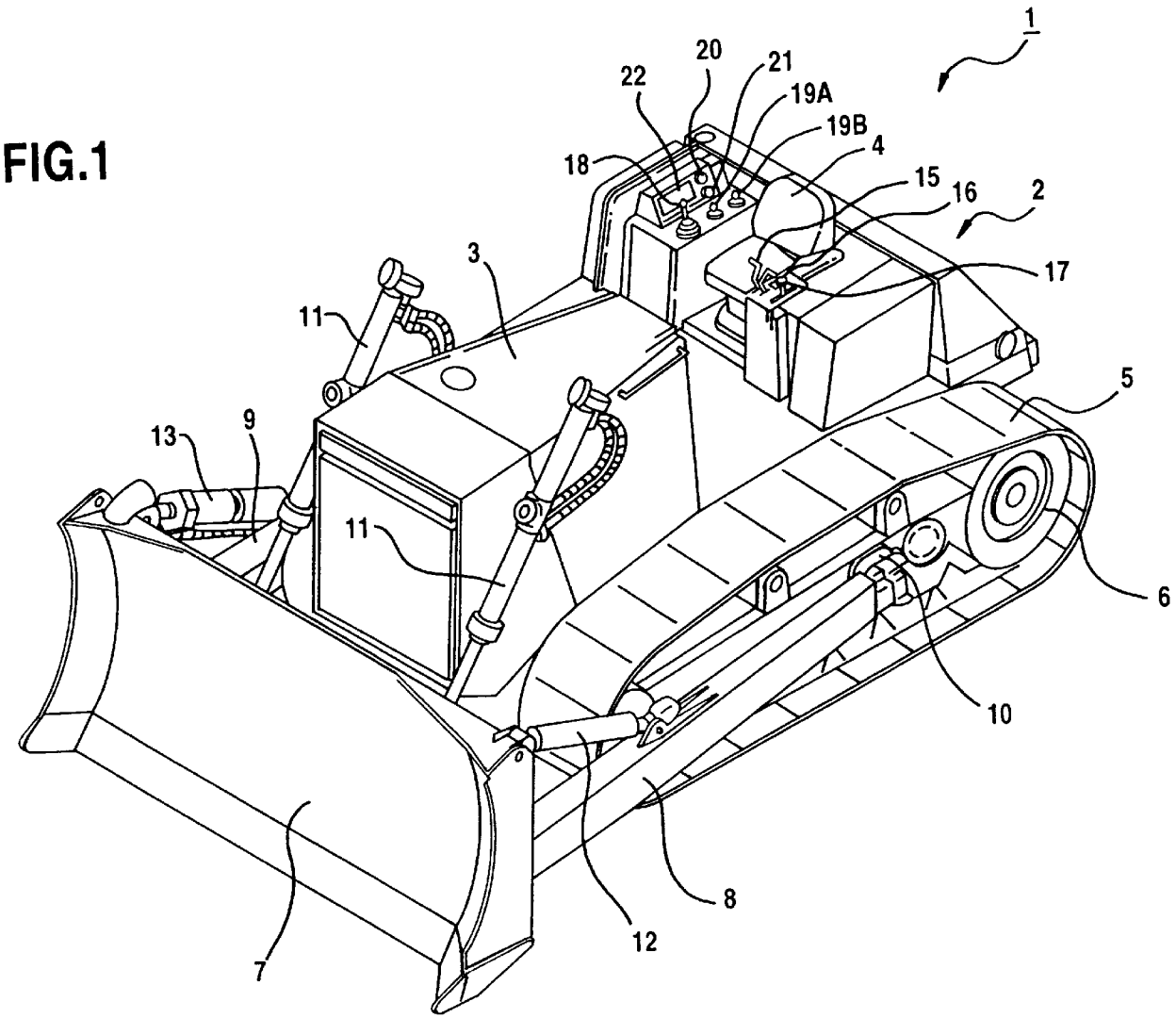
FIG. 1 is an outside view of a bulldozer according to an embodiment of the invention.

FIG. 1 shows the external appearance of a bulldozer 1 having a vehicle body 2 on which a bonnet 3 for housing an engine (not shown) and a cab 4 for the operator who drives the bulldozer 1 are provided. Disposed on both right and left sides of the vehicle body 2 when viewed in the forward moving direction of the vehicle body 2 are crawler belts 5

(the crawler belt on the right side is not shown in the drawing) for driving the vehicle body 2 so as to travel forwardly and reversely and turn. The crawler belts 5 are respectively independently driven by power transmitted from the engine with the aid of corresponding sprockets 6.

A blade 7 is supported at the forward ends of right and left straight frames 8, 9 the base ends of which are, in turn, pivotally supported at the sides of the vehicle body 2 through trunnions 10 (the trunnion on the right side is not shown in the drawing) such that the blade 7 can be lifted or lowered. The blade 7 is provided with a pair of blade lift cylinders 11, 12 laterally disposed between the blade 7 and the vehicle body 2, for lifting or lowering the blade 7. A brace 12 is disposed between the blade 7 and the left straight frame 8 and a blade tilt cylinder 13 is disposed between the blade 7 and the right straight frame 9, the brace 12 and the blade tilt cylinder 13 both serving to tilt the blade 7 to the right or left.

There are provided a steering lever 15, a gear shift lever 16 and a fuel control lever 17 on the left side of the cab 4 when viewed in the forward moving direction of the vehicle body 2. On the right side of the cab 4, there are provided a blade control lever 18 for lifting, lowering, leftwardly tilting or rightwardly tilting the blade 7; a first dial switch 19A for setting the load of excavated soil exerted on the blade 7; a second dial switch 19B for correcting the set load by increasing or decreasing; a drive mode shift switch 20 for switching on or off the automatic drive mode of dozing operation; a lock-up shift switch 21 for switching between the locked-up state and torque converting state of the torque convertor; and a display unit 22. A decelerator pedal is disposed in front of the cab 4 although it is not shown in the drawing.

Figure 2:
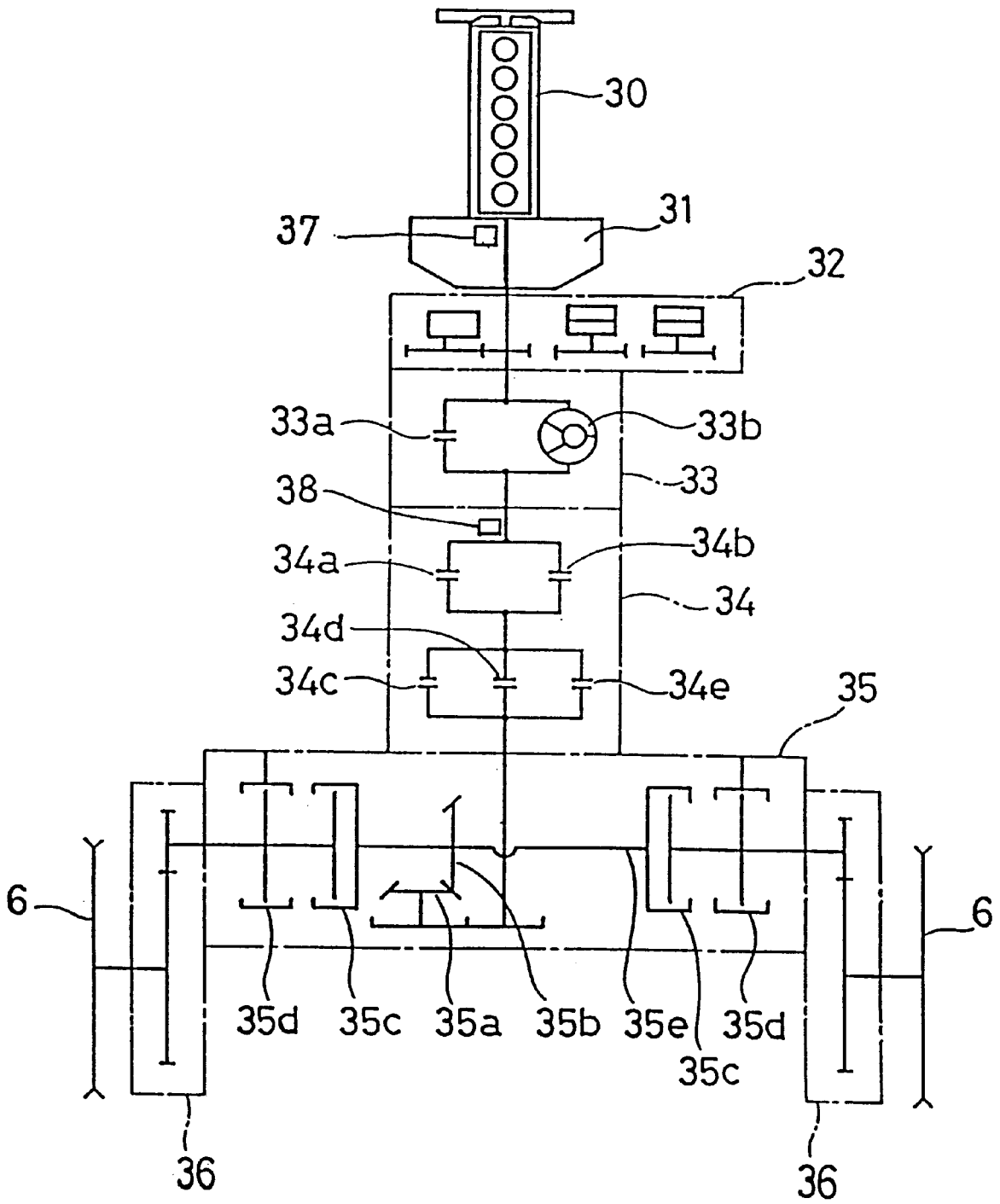
FIG. 2 is a skeleton view of a power transmission system.

In the power transmission system shown in FIG. 2, the rotary driving power from an engine 30 is transmitted to a damper 31 and a PTO 32 for driving various hydraulic pumps including an implement operating hydraulic pump and then to a torque convertor 33 having a lock-up mechanism 33*a* and a pump 33*b*. The rotary driving power is then transmitted from the output shaft of the torque convertor 33 to a transmission 34 (e.g., wet multiple disc clutch type planetary gear transmission) whose input shaft is coupled to the output shaft of the torque convertor 33. The transmission 34 comprises a forward drive clutch 34*a*, reverse drive clutch 34*b* and first to third speed clutches 34*c*, 34*d* and 34*e*, so that the output shaft of the transmission 34 is rotated in three speed ranges in both forward drive and reverse drive. The rotary driving power from the output shaft of the transmission 34 is transmitted to paired right and left final reduction gear mechanisms 36 through a steering system 35 to power the respective sprockets 6 for running the crawler belts 5. The steering system 35 has a transverse shaft 35*e* having a pinion 35*a*, a bevel gear 35*b*, paired right and left steering clutches 35*c* and paired right and left steering brakes 35*d*. Reference numeral 37 designates an engine speed sensor for detecting the engine speed of the engine 30 whereas reference numeral 38 designates a torque convertor output shaft revolution sensor for detecting the revolution speed of the output shaft of the torque convertor 33.

Figure 3:
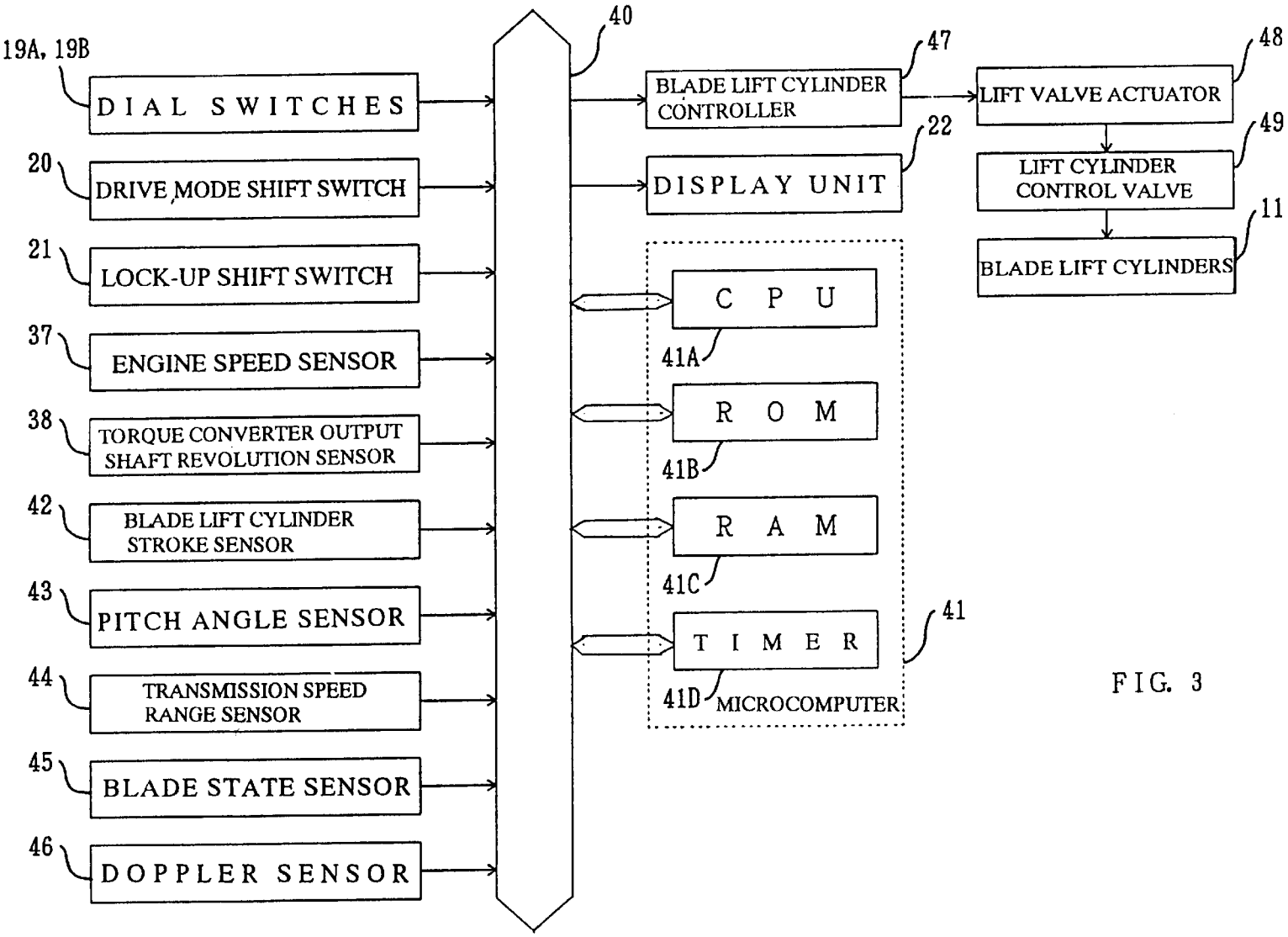
FIG. 3 is a block diagram of the system structure of a dozing system.

Referring to FIG. 3 which schematically illustrates the system structure of the dozing system of the bulldozer according to this embodiment, (i) dial value data that is sent from the first dial switch 19A and representative of a set load of excavated soil imposed on the blade 7; (ii) dial value data that is sent from the second dial switch 19B and representative of a correction value for the set load; (iii) a drive mode selection instruction that is sent from the drive mode shift switch 20 and representative of whether the automatic drive mode or the manual drive mode is to be selected in dozing operation; (iv) a locked-up(L/U)/torque converting(T/C) selection instruction that is sent from the lock-up shift switch 21 and representative of whether or not the torque converter 33 is to be locked up; (v) engine speed data that is sent from the engine speed sensor 37 and representative of the engine speed of the engine 30; and (vi) revolution data that is sent from the torque convertor output shaft revolution sensor 38 and representative of the revolution speed of the output shaft of the torque convertor 33 are all supplied to a microcomputer 41 through a bus 40. Other data supplied through the bus 40 to the microcomputer 41 are (i) stroke position data that is sent from a blade lift cylinder stroke sensor 42 and representative of the stroke positions of the right and left blade lift cylinders 11 for lifting or lowering the blade 7; (ii) pitch angle data that is sent from a pitch angle sensor 43 for detecting the pitch angle of the vehicle body 2 (i.e., the varying angle of the vehicle body 2 pitching fore and aft momentarily); (iii) speed range data that is sent from a transmission speed range sensor 44 and representative of which speed range the transmission 34 has been placed in (i.e., which of the three speed ranges in forward drive and reverse drive has been selected) by operating the gear shift lever 16; (iv) manual drive operation state data that is sent from a blade state sensor 45 and representative of whether the blade 7 is being manually operated by the blade control lever 18; and (v) ground speed data that is sent from a Doppler sensor 46 and representative of the ground speed of the vehicle.

The microcomputer 41 is composed of a central processing unit (CPU) 41A for executing a specified program; a read only memory (ROM) 41B for storing this program and various maps such as an engine characteristic map and a torque convertor characteristic map; a random access memory (RAM) 41C serving as a working storage and registers necessary for executing the program; and a timer 41D for measuring elapsed time for an event in the program. According to the dial value data representative of a set load of excavated soil imposed on the blade 7; the dial value data representative of a correction value for the set load; the drive mode selection instruction representative of whether the automatic drive mode or the manual drive mode is to be selected in dozing operation; the L/U–T/C selection instruction representative of whether the torque convertor 33 is to be put in the locked-up state or torque converting state; the engine speed data representative of the engine speed of the engine 30; the revolution data representative of the revolution speed of the output shaft of the torque convertor 33; the stroke position data representative of the stroke position of the right lift cylinder 11 and the stroke position data representative of the stroke position of the left blade lift cylinder 11; the pitch angle data of the vehicle body 2; the speed range data of the transmission 34; the manual drive operation state data of the blade 7; and the ground speed data of the vehicle, the above specified program is executed. By the execution of the program, the amount of lifting or lowering the blade 7 (i.e., lift operation amount) is fed to a blade lift cylinder controller 47 and the right and left blade lift cylinders 11 are actuated through a lift valve actuator 48 and a lift cylinder control valve 49 according to the lift operation amount, so that the blade 7 can be lifted or lowered by a desired amount. The display unit 22 displays, for example, whether the bulldozer 1 is presently in the automatic drive mode or the manual drive mode of dozing operation.

Figure 4:
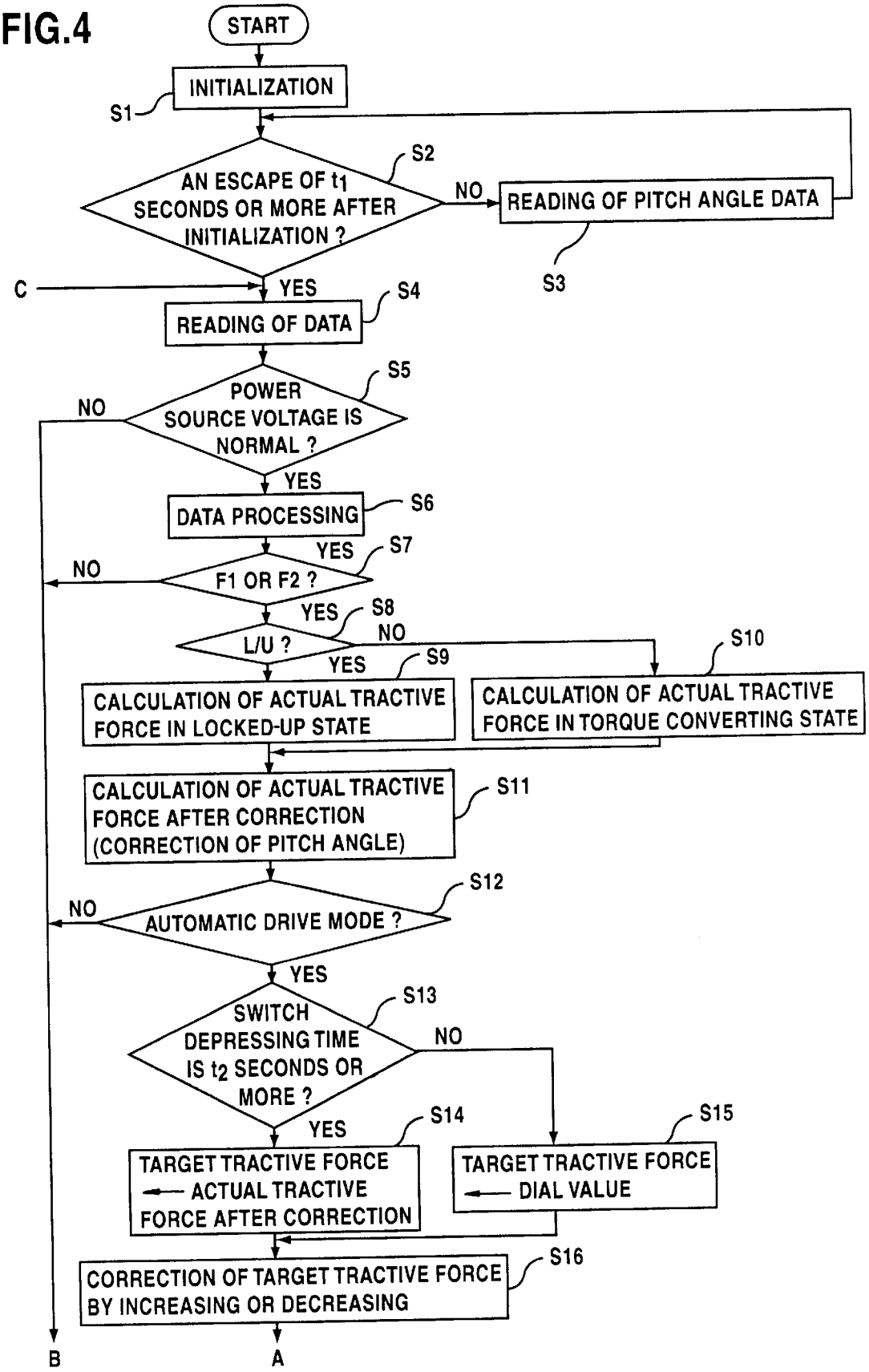
FIG. 4 is a flow chart (first stage) of an operation performed by the dozing system.

The operation of the dozing system of the bulldozer having the above system structure will be described in detail with reference to the flow charts of FIGS. 4 and 5.

S1 to S3: An execution of the specified program is started by turning on the power source and initialization is done, for example, by clearing the contents of the registers in the RAM 41C of the microcomputer 41. For a time period $t_1$ after the initialization, pitch angle data are sequentially read from the pitch angle sensor 43 as an initial value. The reason why the sequential pitch angle data are read as an initial value is that the pitch angle of the vehicle body 2 is obtained from the frequency separation of the pitch angle data utilizing the method of moving averages.

S4 to S6: The dial value data representative of a set load of excavated soil imposed on the blade 7 is read from the first dial switch 19A. The dial value data representative of a correction value for the set load is read from the second dial switch 19B. The drive mode selection instruction is read from the drive mode shift switch 20. The L/U–T/C selection instruction is read from the lock-up shift switch 21. The engine speed data of the engine 30 is read from the engine speed sensor 37. The revolution data of the torque convertor 33 is read from the torque convertor output shaft revolution sensor 38. The stroke position data of the right blade lift cylinder 11 and the stroke position data of the left blade lift cylinder 11 are read from the blade lift cylinder stroke sensor 42. The pitch angle data of the vehicle body 2 is read from the pitch anglesensor 43. The speed range data of the transmission 34 is read from the transmission speed range sensor 44. The manual drive operation state data of the blade 7 is read from the blade state sensor 45. The ground speed data of the vehicle is read from the Doppler sensor 46. If the voltage of the power source is normal, being more than a specified value and the electronic circuit and others are in their normal operating condition, the following data processing will be carried out.

(1) The low frequency components of the sequential pitch angle data are extracted by the frequency separation of the pitch angle data utilizing the method of moving averages, whereby the pitch angle of the vehicle body 2 is obtained.

(2) The acceleration components are extracted as the acceleration of the vehicle body 2 by deducting the low frequency components from the sequential pitch angle data.

(3) The stroke position data pieces of the right and left blade lift cylinders 11 are averaged to obtain average stroke position data based on which, the average of the angles of the right and left straight frames 8, 9 in relation to the vehicle body 2 is obtained as a straight frame relative angle $\phi_1$.

(b 4) From the straight frame relative angle $\phi_1$ and the pitch angle of the vehicle body 2 obtained in the way described in the column (1), the average of the angles of the right and left straight frames 8, 9 relative to the ground is obtained as a straight frame absolute angle. Then, a moving average straight frame absolute angle $\phi_2$ is obtained from the moving average of the sequential data on the straight frame absolute angle which has been read for 5 seconds.

S7 to S11: If the transmission 34 is placed in the first forward speed (F1) or the second forward speed (F2), actual speed $F_R$ is calculated, selecting either of the following ways according to whether the L/U–T/C selection information indicates the locked-up state or torque converting state.

Figure 6:
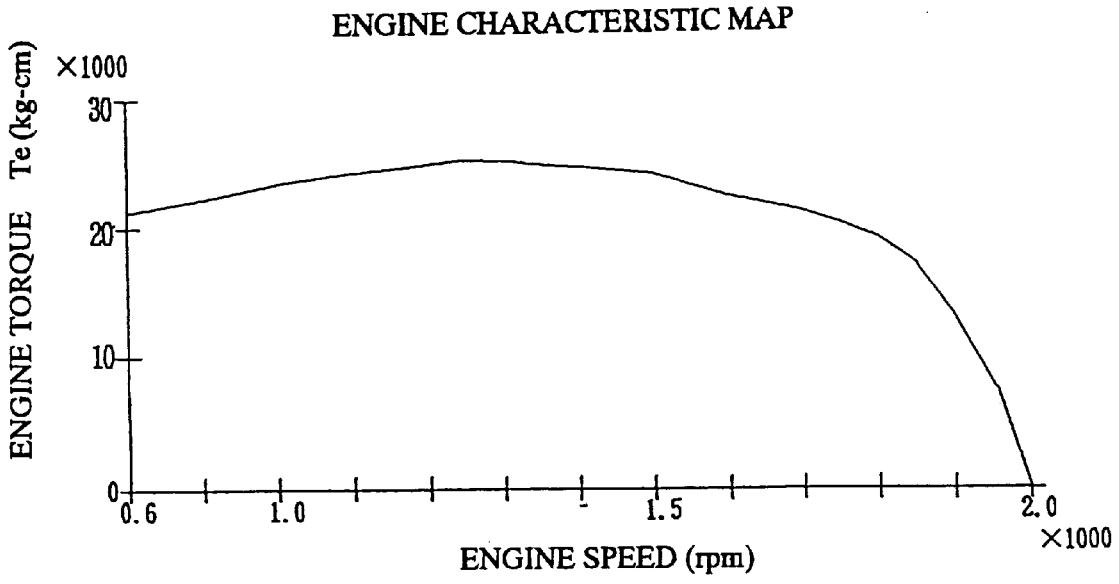
FIG. 6 is a graph of an engine characteristic curve.
Figure 7:
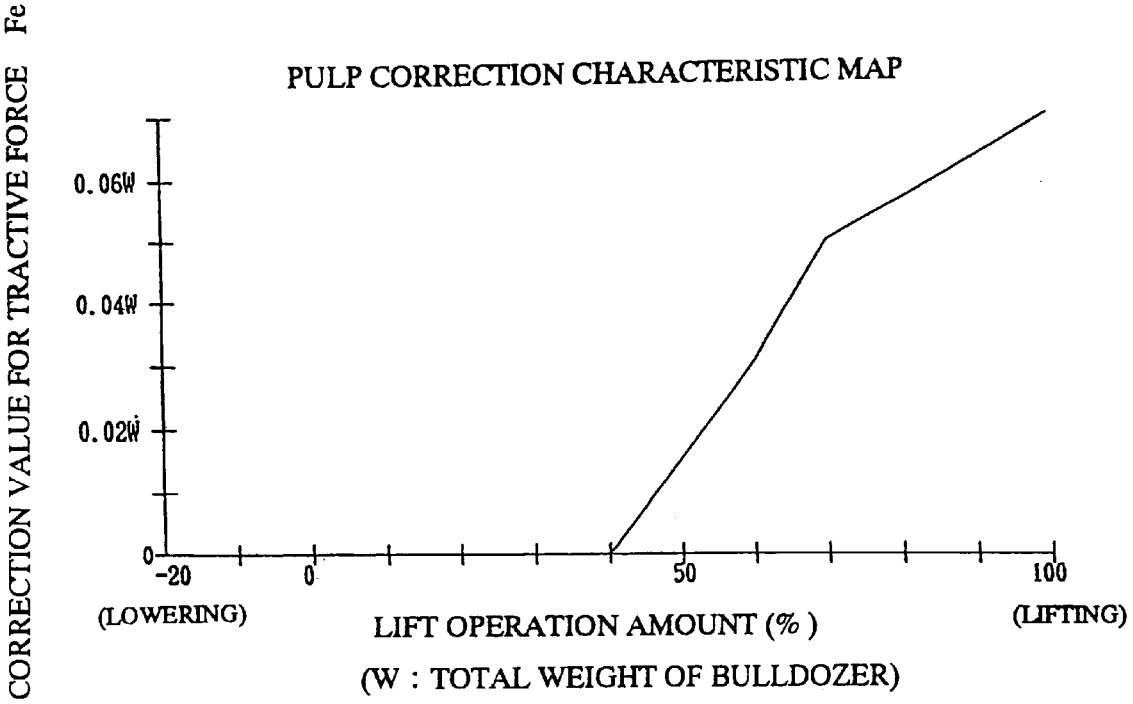
FIG. 7 is a graph of a pump correction characteristic curve.

1. Where the torque convertor 33 is in the locked-up (LU) state:

Engine torque Te is obtained from the engine characteristic map shown in FIG. 6, using the engine speed Ne of the engine 30. Then, the engine torque Te is multiplied by a reduction ratio $k_{se}$ from the transmission 34 to the final reduction mechanisms 36 through the steering system 35 (in other words, the reduction ratio between the output shaft of the torque convertor 33 and the sprockets 6) and further multiplied by the diameter r of the sprockets 6, to obtain tractive force Fe ($=Te\times k_{se}\times r$). A tractive force correction value Fc is subtracted from the tractive force Fe, thereby obtaining actual tractive force $F_R$ ($=Fe-Fc$). The tractive force correction value Fc corresponds to the consumption of the hydraulic pumps (e.g., the implement operating hydraulic pump working on the blade lift cylinders 11 in the PTO 32), and can be obtained from the pump correction characteristic map shown in FIG. 7, using the lift operation amount of the blade 7.

Figure 8:
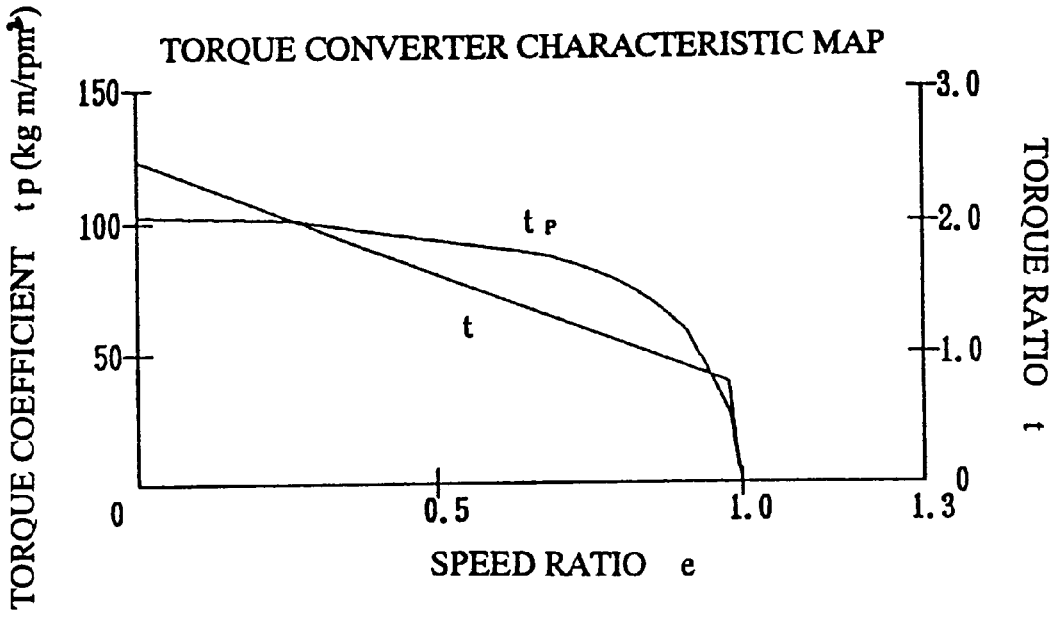
FIG. 8 is a graph of a torque convertor characteristic curve.

2. Where the torque convertor 33 is in the torque converting (TC) state:

A torque coefficient $t_p$ and torque ratio t are obtained from the torque convertor characteristic map shown in FIG. 8, using speed ratio e (=Nt/Ne) that is the ratio of the engine speed Ne of the engine 30 to the revolution speed Nt of the output shaft of the torque convertor 33, and then torque convertor output torque Tc ($=t_p\times(Ne/1000)^2\times t$) is obtained. Similarly to the case 1, the torque convertor output torque Tc is multiplied by the reduction ratio $k_{se}$ between the output shaft of the torque convertor 33 and the sprockets 6 and further multiplied by the diameter r of the sprockets 6, to obtain actual tractive force $F_R$ ($=Tc\times k_{se}\times r$).

Figure 9:
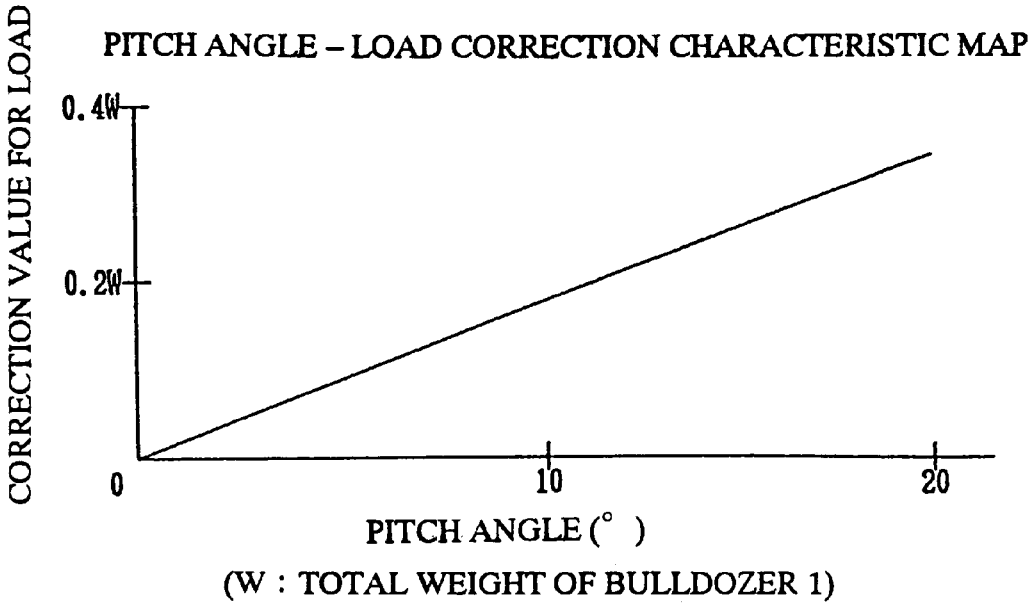
FIG. 9 is a graph of a pitch angle-load correction characteristic curve.

Then, the load correction value which corresponds to the pitch angle of the vehicle body 2 and which has been obtained from the pitch angle-load correction characteristic map shown in FIG. 9 is subtracted from the actual tractive force $F_R$, thereby obtaining actual tractive force after correction F.

S12 to S16: If the drive mode selection instruction sent from the drive mode shift switch 20 indicates that the automatic drive mode of dozing operation is selected, the following processing is carried out.

(1) If the length of time the drive mode shift switch 20 has been depressed for mode changing is $t_2$ seconds or more, the actual tractive force after correction F is set as target tractive force $F_0$.

(2) If the length of time the drive mode shift switch 20 has been depressed for mode changing is less than $t_2$ seconds, the set load of excavated soil imposed on the blade 7 input by the first dial switch 19A is set as target tractive force $F_9$.

Then, the target tractive force $F_0$ is increased or decreased by the amount corresponding to the value input by the second dial switch 19B which value is a correction value for the set load input by the first dial switch 19A, whereby target tractive force $F_0$ is determined.

S17 to S19: If $t_3$ seconds or more have elapsed after the automatic drive mode of dozing operation was selected in response to the drive mode selection instruction sent from the drive mode shift switch 20, the moving average straight frame absolute angle $\phi_2$ is set as a target position $\phi_0$ of the cutting edge of the blade 7 relative to the ground. If a time less than $t_3$ seconds has elapsed, the straight frame relative angle $\phi_1$ is set as a target position $\phi_0$ of the cutting edge of the blade 7 relative to the ground.

S20 to S22: If the blade 7 is not manually driven by the blade control lever 18, the difference $\Delta F$ between the target tractive force $F_0$ and the actual tractive force after correction F and the difference $\Delta\phi$ between the target position $\phi_0$ of the cutting edge of the blade 7 relative to the ground and the moving average straight frame absolute angle $\phi_2$ are obtained while the display unit 22 displays that dozing operation is carried out in the automatic drive mode.

S23 to S25: Whether or not a shoe slip (i.e., running slip) of the vehicle body 2 has occurred is determined in the following way, based on the moving average acceleration and the actual tractive force after correction F. Note that the moving average acceleration is obtained from the moving average of acceleration of the vehicle body 2 obtained from the acceleration components extracted from the pitch angle data by frequency separation.

1. If either the following condition (1) or (2) is satisfied, an occurrence of running slip is admitted.

(1°=0.0174G, W=total weight of the bulldozer 1)

(1) moving average acceleration $\alpha<-4°$ or (2) moving average acceleration $\alpha<-2°$ and actual tractive force after correction F>0.6W 2. If either the following condition (1) or (2) is satisfied, it is admitted that running slip has stopped after occurrence.

(1) moving average acceleration $\alpha>0.1°$ or (2) actual tractive force after correction F>actual tractive force after correction F at a start of running slip −0.1W After judging whether or not a running slip has occurred based on the foregoing conditions, the program proceeds to either of the following steps in accordance with a result of the judgment.

1. If an occurrence of running slip is detected, a lift operation amount $Q_S$ for lifting, the blade 7 is obtained from a slip control characteristic map (not shown) in order to eliminate the running slip by reducing the load of excavated soil imposed on the blade 7.

2. If no running slip has been detected, lift operation amounts $Q_1$ and $Q_2$ are obtained in the following way.

Figure 10:
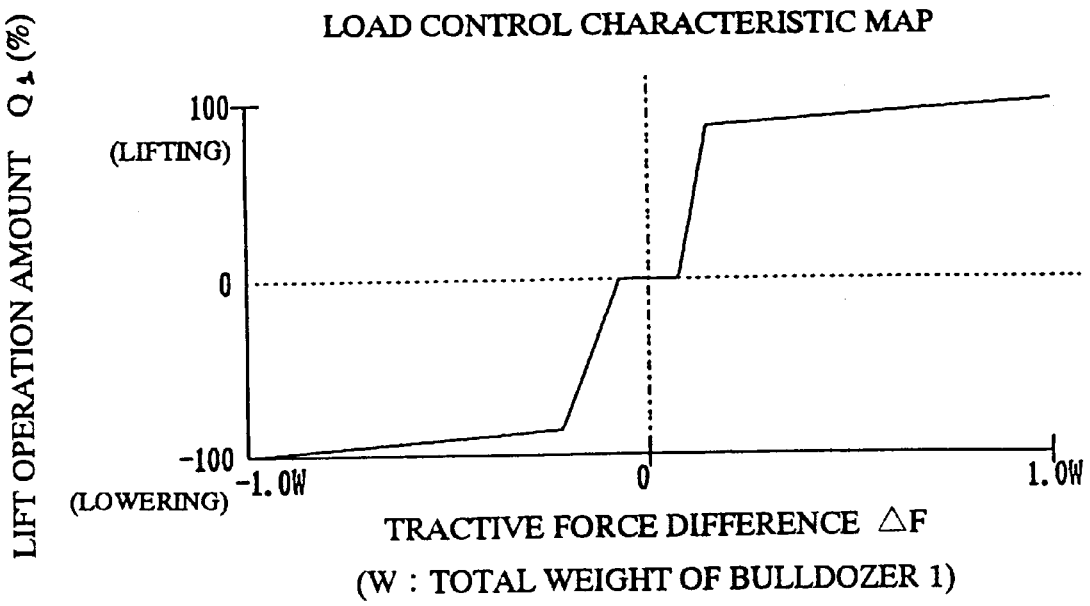
FIG. 10 is a graph of a load control characteristic curve.

(1) A lift operation amount $Q_1$ for lifting or lowering the blade 7 such that the actual tractive force after correction F becomes coincident with the target tractive force $F_0$ is obtained from the load control characteristic map shown in FIG. 10, using the difference ΔF between the target tractive force $F_0$ and the actual tractive force after correction F.

Figure 11:
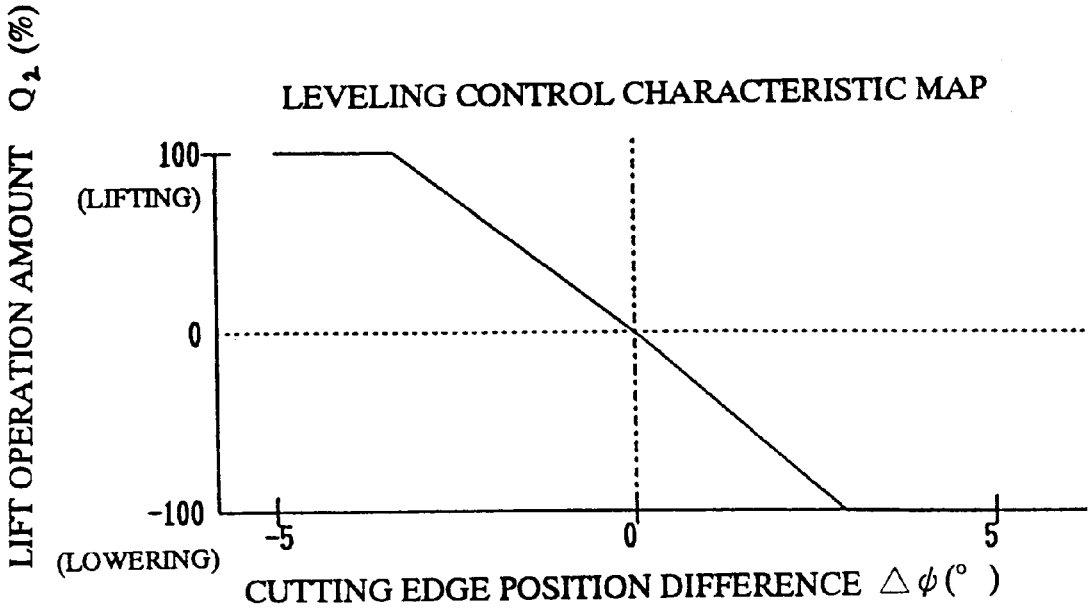
FIG. 11 is a graph of a leveling control characteristic curve.

(2) A lift operation amount $Q_2$ for lifting or lowering the blade 7 such that the moving average straight frame absolute angle $\phi_2$ becomes coincident with the target angle $\phi_0$ of the cutting edge of the blade relative to the ground is obtained from the leveling control characteristic map shown in FIG. 11, using the difference $\Delta\phi$ between the target angle $\phi_0$ of the cutting edge of the blade relative to the ground and the moving average straight frame absolute angle $\phi_2$.

Figure 12:
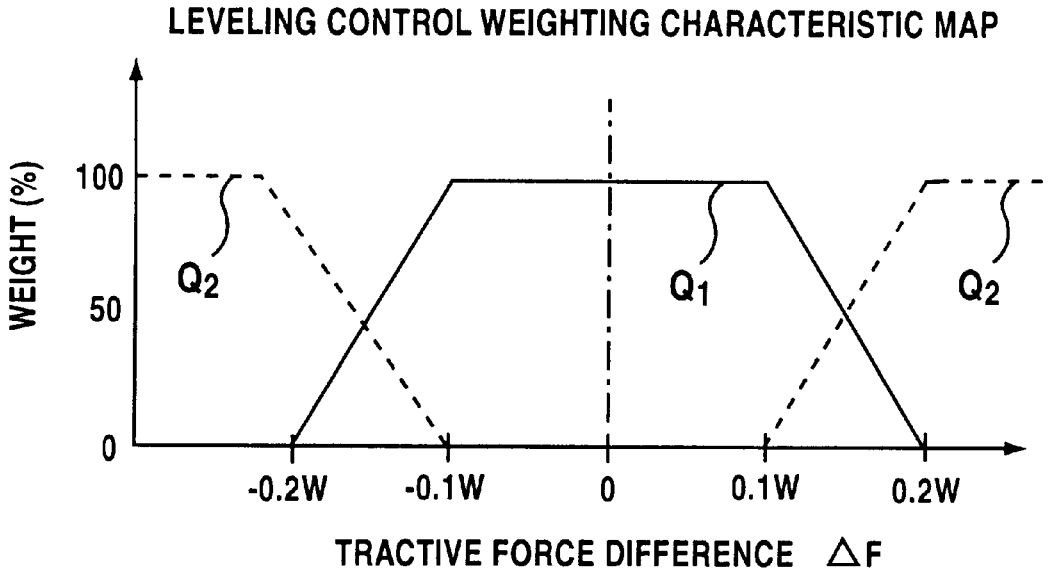
FIG. 12 is a graph of a load-leveling control weighting characteristic curve.

(3) A lift operation amount $Q_T$ is obtained by obtaining the sum of the lift operation amounts $Q_1$ and $Q_2$ which are weighted based on the tractive force difference ΔF according to the load-leveling control weighting characteristic map shown in FIG. 12. It should be understood that the tractive force difference ΔF is within ∓0.1W in the weighting map of FIG. 12, the normal load control has priority.

Figure 13:
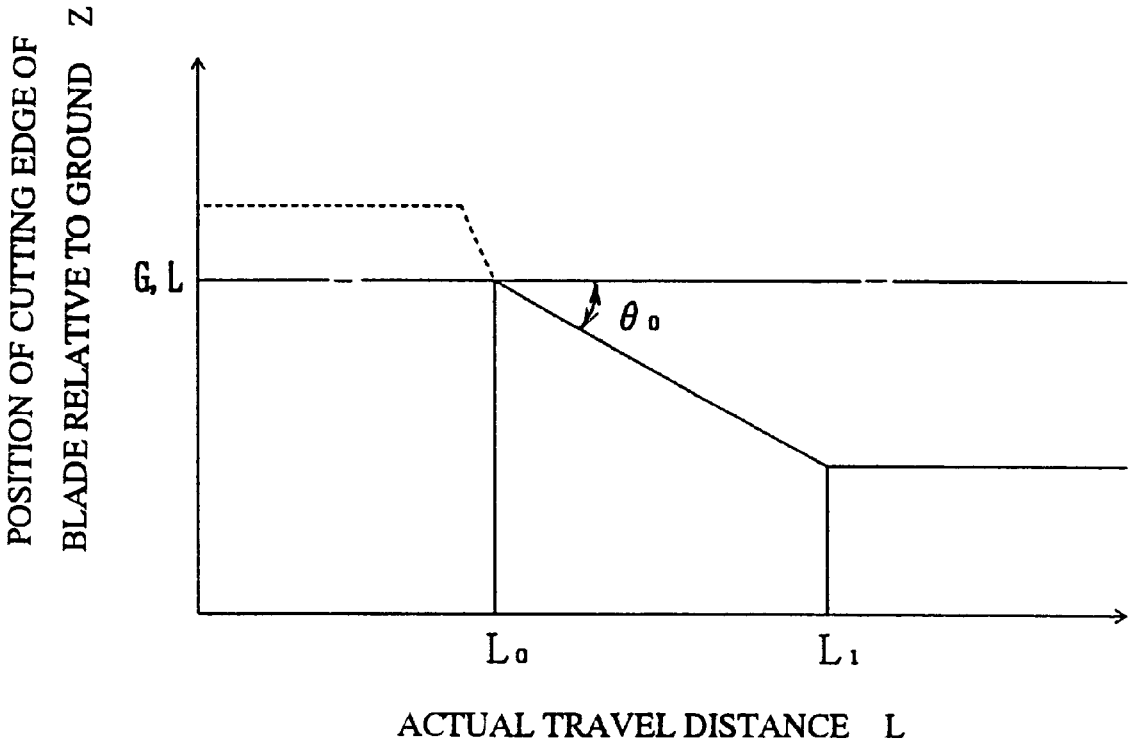
FIG. 13 is a graph showing the relationship between actual travel distance and the position of the cutting edge of a blade relative to the ground.

S26 to S28: The position of the bulldozer 1 when the position of the cutting edge of the blade 7 has reached the ground level G.L. (i.e., reference level) after a start of automatic excavation is represented by $L_0$ as shown in FIG. 13. A check is made to determine if the position of the cutting edge of the blade 7 relative to the ground after the bulldozer 1 has passed the point $L_0$ is below G.L. If the position of the cutting edge is determined to be below G.L., the actual travel distance L of the bulldozer 1 from the point $L_0$ is obtained by integrating the actual vehicle speed data from the Doppler sensor 46 and the depth of digging Z from G.L. is obtained from the blade cutting edge position data. Then, the cutting angle θ of the blade 7 is obtained from the actual travel distance L and the depth of digging Z and tanθ=Z/L is obtained. If the cutting angle θ of the blade 7 is larger than a preset maximum cutting angle (target cutting angle) $\theta_0$ ($\theta>\theta_0$) and the automatic digging instruction indicates lowering of the blade 7, the blade lowering instruction is disabled and a blade keeping instruction is released as an output. Note that the maximum cutting angle $\theta_0$ is set beforehand by means of a dial switch.

S29: If the position of the cutting edge of the blade 7 is determined not to be below G.L. in step S26, or if the cutting angle θ of the blade 7 is equal to or smaller than the maximum cutting angle $\theta_0$ ($\theta\leqq\theta$) even though the position of the cutting edge is below G.L., the lift operation amounts $Q_S$, $Q_T$ calculated in steps S24, S25 are supplied to the blade lift cylinder controller 47 in order to perform the normal load control. According to the lift operation amounts $Q_S$, $Q_T$, the blade lift cylinders 11 are controlled through the lift valve actuator 48 and the lift cylinder control valve 49 so that the blade 7 is desirably controlled to be lifted or lowered.

S30 to S31: If the voltage of the power source is not normal, that is, lower than the specified voltage and the electronic circuit and others function abnormally, or if the transmission 34 is neither the first forward speed (F1) nor the second forward speed (F2), or if the drive mode selection instruction sent from the drive mode shift switch 20 indicates a selection of the manual drive mode of dozing operation, or if the blade 7 is manually driven by the blade control lever 18, a lift operation amount $Q_N$ for lifting or lowering the blade 7 is obtained from a manual control characteristic map (not shown), according to the operation amount of the blade control lever 18. Then, the lift operation amount $Q_N$ is supplied to the blade lift cylinder controller 47 to drive the blade lift cylinders 11 through the lift valve actuator 48 and the lift cylinder control valve 49.

In this way, the blade 7 is controlled such that the cutting angle θ of the blade 7 becomes coincident with the preset maximum cutting angle $\theta_0$, when the bulldozer 1 travels from the point $L_0$ to the point $L_1$ (see FIG. 13) after the cutting edge of the blade 7 has reached G.L. after a start of automatic excavation. Thus, blade control is performed with a preset target cutting angle, which permits the blade 7 to stably cut into the ground at a start of excavation irrespective of soil conditions, namely, whether the soil to be excavated is soft or hard. This arrangement enables a dozing system which less frequently requires the manual control intervention by the operator and therefore performs easier automatic control. It should be noted that the normal load control is performed after the bulldozer 1 has passed the point $L_1$.

While the cutting angle θ of the blade 7 is obtained from the ratio (Z/L) of the depth of digging Z from the ground level G. L. to the travel distance L of the bulldozer 1 from the position $L_0$ in this embodiment, the cutting angle θ may be obtained from a change ΔZ in the position of the cutting edge of the blade 7 per unit travel distance ΔL of the bulldozer 1 (e.g., 10 cm), as described by the following equation.

$$\tan\theta=\Delta Z/\Delta L$$

While the maximum cutting angle (i.e., target cutting angle) $\theta_0$ is set by means of a dial switch in this embodiment, it may be set by teaching by the operator or self learning by the bulldozer 1. Alternatively, the maximum cutting angle $\theta_0$ may be set by using a prestored data map showing the relationship between the position of the cutting edge of the blade and the travel distance of the bulldozer.

While the travel distance of the bulldozer 1 is obtained by integrating data on the vehicle speed of the bulldozer 1 detected by a Doppler sensor, the detection of the vehicle speed may be done by detecting the revolution speed of the sprockets mounted to the crawler belts.

We claim:

1. A dozing system for use in a bulldozer, the system comprising:

(a) target cutting angle setting means for setting a target cutting angle of a blade when the bulldozer is in an automatic drive mode in dozing operation;

(b) actual cutting angle detecting means for detecting an actual cutting angle of the blade relative to the ground; and (c) blade control means for controlling the blade to be lifted or lowered, at a start of excavation when the bulldozer is in the automatic drive mode in dozing operation, such that the actual cutting angle of the blade detected by the actual cutting angle detecting means becomes coincident with the target cutting angle of the blade set by the target cutting angle setting means, wherein the cutting angle of the blade is an angle defined between: (a) a ground level, and (b) a path defined by a slope of a digging depth of the blade per unit travel distance of the blade from an excavation starting point of the blade.

2. A dozing system according to claim 1, wherein the target cutting angle setting means sets the target cutting angle using a dial switch.

3. A dozing system according to claim 1, wherein the target cutting angle setting means sets the target cutting angle using a look-up data map that shows a relationship between a travel distance of the bulldozer and a position of a cutting edge of the blade.

* * * * *